United States Patent [19]

Johnson

[11] 4,281,267

[45] Jul. 28, 1981

[54] HIGH INTENSITY DISCHARGE LAMP WITH COATING ON ARC DISCHARGE TUBE

[75] Inventor: Peter D. Johnson, Schenectady, N.Y.

[73] Assignee: General Electric Company, Schenectady, N.Y.

[21] Appl. No.: 38,464

[22] Filed: May 14, 1979

[51] Int. Cl.[3] ..... H01J 61/35

[52] U.S. Cl. ..... 313/25; 313/44; 313/47; 313/221

[58] Field of Search ..... 313/44, 47, 221, 25, 313/229

[56] References Cited

U.S. PATENT DOCUMENTS

| | | | |
|---|---|---|---|
| 2,951,967 | 9/1960 | Naxon | 313/112 X |
| 3,234,421 | 2/1966 | Reiling | 313/229 X |
| 3,445,719 | 5/1969 | Thouret et al. | 313/229 X |
| 3,753,019 | 8/1973 | Hellman | 313/229 X |
| 3,858,078 | 12/1974 | Koury | 313/25 X |
| 3,883,763 | 5/1975 | Kearney | 313/25 X |
| 3,900,750 | 8/1975 | Bamberg et al. | 313/44 |
| 3,963,951 | 6/1976 | Bamberg | 313/44 |

*Primary Examiner*—Palmer C. Demeo

*Attorney, Agent, or Firm*—Alexander M. Gerasimow; James C. Davis; Marvin Snyder

[57] ABSTRACT

In high intensity discharge lamps, particularly those that are configured to operate in a particular orientation, end coatings are provided which increase the efficacy of the lamp. In one embodiment of the present invention, reflective end coatings are provided exteriorly and at the ends of the discharge tube except for an approximately semicircularly shaped portion through which the optical output of the lamp radiates. The particular coating pattern provided in the present invention reduces the number of internal reflections occurring within the discharge tube and accordingly increases the efficacy of the lamp.

6 Claims, 4 Drawing Figures

HIGH INTENSITY DISCHARGE LAMP WITH COATING ON ARC DISCHARGE TUBE

BACKGROUND OF THE INVENTION

This invention relates to high intensity discharge lamps and in particular to reflective coating patterns for the discharge tube.

High intensity arc discharge lamps of the kind discussed herein are typically found in street lighting and parking lot lighting applications and other applications requiring a high intensity, efficient light source. These lamps conventionally operate by passing electrical current through an ionizable vapor typically contained in a transparent quartz discharge tube. At either end of the quartz tube there is an electrode for carrying the ionizing electric current. The operation of these lamps is similar to the operation of conventional fluorescent lamps except that the electrodes herein need not be heated filaments as in fluorescent lamps and a phosphor coating is not required for the production of light output; in these lamps, the excitation of the ionizable vapor itself is responsible for the emission of visible wavelength photons. The discharge tube itself operates at a relatively high temperature and accordingly it is typically contained in an exterior envelope not only for safety but also for the purpose of maintaining the discharge tube at a sufficient temperature so that the desired vapor pressure of the ionizable medium within the discharge tube is maintained. The ionizable medium typically comprises a mercury-metal halide mixture but other ionizable media may also be employed, the exact mixture often being dependent upon the desired color spectrum of the emitted light. To conserve heat in the discharge tube, a white or metallic reflective coating is employed to conserve heat energy in the tube to maintain the desired vapor pressure. The coating typically extends along the arc tube wall beyond the tips of the electrodes which are typically disposed at opposed ends of the tube. Accordingly, considerable useful radiation is partially trapped within the tube by multiple internal reflections which results in a reduction in efficacy of as much as approximately 10 percent as compared to other methods of maintaining the vapor pressure.

Vertical operation of such high intensity discharge lamps typically poses few problems with respect to the arc location within the envelope. However, during horizontal operation there is a tendency for the arc discharge to bow upwards often contacting the top wall of the arc tube due to convection and buoyancy of the less dense, hot plasma in the region dissipating the greatest amount of energy. This effect results in a loss of efficiency due to cooling of the plasma by conduction through the top wall of the arc tube and also results in shortened life and even possibly catastrophic lamp failure due to overheating of the top wall of the quartz envelope which typically operates at a temperature of approximately 900° C. Two basic configurations have been proposed to reduce this problem. In the first configuration, the discharge tube itself is arched so as to conform to the natural upward curvature of the plasma arc. Such an arched discharge tube is described, for example in U.S. Pat. No. 4,142,122 issued to Koza. A second configuration which reduces this problem by arc bowing is to place a structure producing a magnetic field in the vicinity of the lamp so as to confine the arc discharge and remove it from the vicinity of the discharge tube wall. Such a configuration is described, for example, in U.S. Pat. No. 2,027,383 issued Jan. 14, 1936 to C. E. Kenty and also in application Ser. No. 945,559, filed Sept. 25, 1978, the latter being incorporated herein by reference. These configurations, which are particularly useful for horizontally operated high intensity discharge lamps, have a unique feature in common in that they both generally require the lamp to be oriented in a particular direction for proper operation. For example, in the case that the discharge tube is arched, the lamp is generally required to be positioned so that the peak of the arch is also the highest point gravitationally. This generally requires a definite orientation for the lamp and likewise tends to require the use of a bayonent-type base, rather than a screw-in base for the lamp.

SUMMARY OF THE INVENTION

In accordance with a preferred embodiment of the present invention, the heat conserving reflective coating used on the arc discharge tube exteriorly coats the entire end of the tube except for an approximately semicircular portion. In other words, the reflective coating does not coat the entire circumference of the arc tube and end walls as is conventional, but rather an approximately semicircular portion of the coating is not present whereby multiple internal reflections are reduced and radiation from each end of the arc tube is permitted to escape. While employable in any high intensity discharge lamp, the coatings of the present invention are particularly applicable for those high intensity discharge lamps having a preferred orientation either because the arc tube is arched or because of the presence of arc positioning electromagnetic structures.

Also, discharge tubes used in the high intensity discharge lamps considered herein typically possess flat pinch-off flanges located at the tube ends through which the electrode leads are disposed. When employed in arched discharge tubes, these flanges are preferably oriented in a plane perpendicular to the plane of the arch, and thus configured with arched tubes, the coatings of the present invention further serve to reduce convective heat losses.

Accordingly, it is an object of the present invention to provide reflective end coatings for the arc discharge tubes of high intensity discharge lamps which operate to conserve heat energy for maintaining proper vapor pressure but yet which increase lamp efficacy by reducing multiple internal reflections and also serving to increase the light output from the lamp.

DETAILED DESCRIPTION OF THE INVENTION

Figure 1:
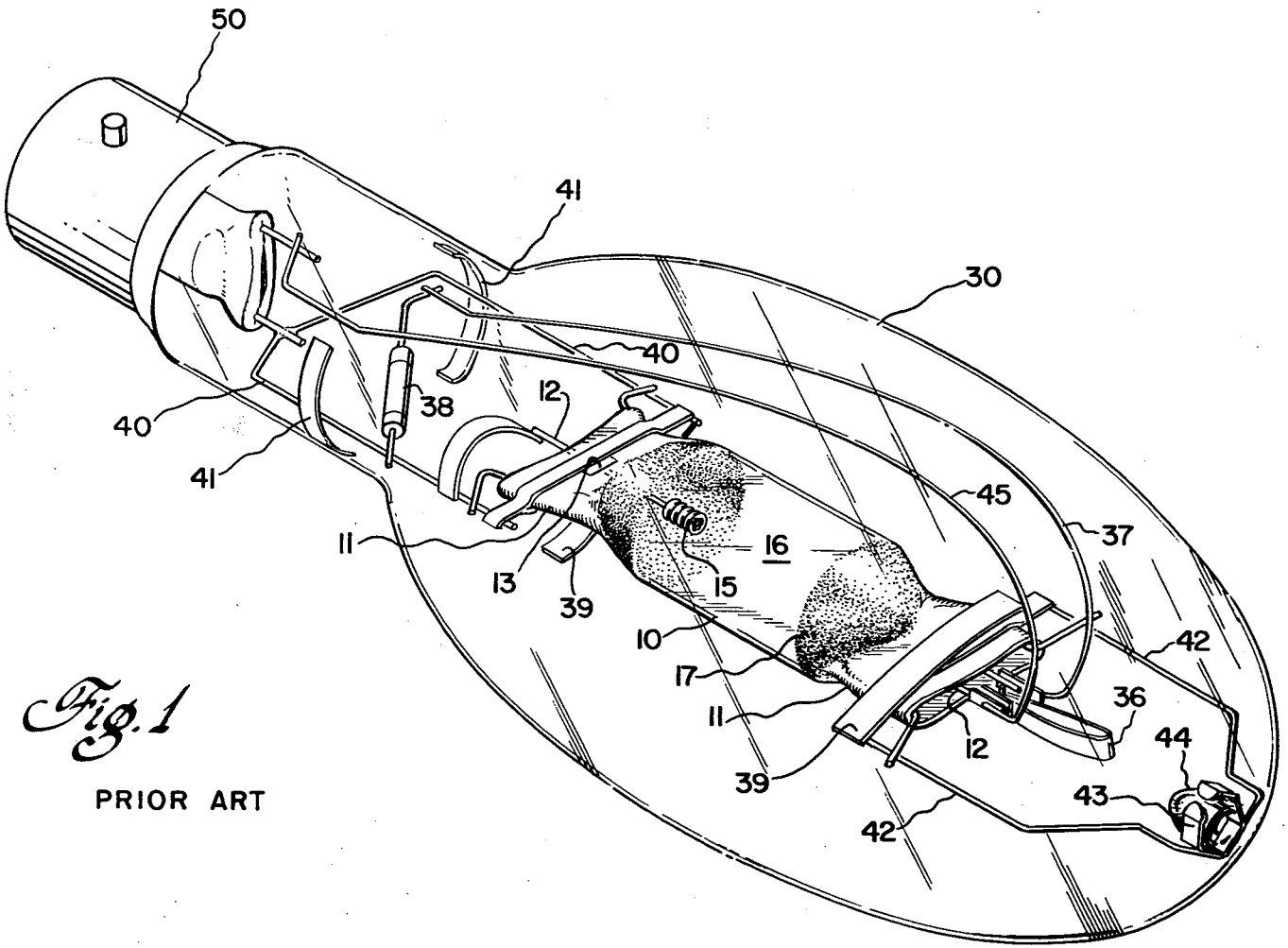
Fig. 1 PRIOR ART
FIG. 1 is a perspective view illustrating a conventional high intensity discharge lamp.

FIG. 1 illustrates a conventional high intensity discharge lamp. While shown with a bayonet-type base, these lamps may also employ a screw-in type base but are typically not suitable for an insertion into standard incandescent sized lamp sockets. Additionally, special ballasting circuits are required for typical operation of the lamp of the present invention. The bayonet-type base is preferred for those lamps which require a special orientation such as occurs when the lamp of FIG. 1 employs the particular coating illustrated in FIG. 2. In particular, in FIG. 1, supported within outer transparent envelope 30 which typically comprises a relatively standard glass material, there is centrally disposed arc discharge tube 10 which typically comprises quartz or a transparent or translucent (that is light-transmissive) ceramic material capable of withstanding temperatures in excess of 500°. Disposed within the arc discharge tube 10 are electrodes 15 at opposite ends of said tube which typically possesses an elongate cylindrical shape, flattened into pinch-off flanges 11 at either end. Also disposed at one end of said tube 10 is a starting electrode (not visible in the figure) disposed a short distance from one of the electrodes so as to facilitate an initial ionization of the vapor 16 contained within tube 10. Vapor 16 comprises mercury vapor and, if desired, a metal halide. The excitation of vapor 16 by the passage of electric current through it, between electrodes 15, is responsible for the production of visible wavelength photons.

The lamp is usually started through ionization of vapor 16 between the starting electrode and one of the electrodes 15. This initial ionization facilitates ionization of a substantial portion of the vapor 16 and leads to an increasing discharge throughout the entire interior volume of tube 10 and the passage of a discharge current between the electrodes 15. The resultant discharge heats the tube and, eventually bimetal strip 36 acts to electrically connect the starting electrode to one of the electrodes 15 so as to reduce electrolysis of the halides.

Strip members 39 connected to support members 40 and 42 have deposited on them a gettering material which acts to remove gases such as oxygen from the volume between the inner tube 10 and the outer envelope 30. Support member 40 is typically connected to one side of the power supply and has spring members 41 spot welded thereto for increased support for the inner lamp structure consisting essentially of transparent arc tube 10. Arc tube 10 is also supported from the other end of the outer envelope 30 by means of dimple 44 in envelope 30, said dimple 44 providing an attachment structure for hexagonal band 43 to which support structure 42 is attached. Support structures 40 and 42 are typically attached by spot welding to a strap snuggly fixed to pinch-off flanges 11. A support structure such as that shown in FIG. 1 is typical and provides a sufficient rigid support for discharge tube 10 and its associated structures. Such a structural configuration is well adapted to withstand prescribed standard drop tests. Additionally shown in FIG. 1 is return lead 45 which is connected to the other terminal of the power supply of the lamp.

Figure 2:
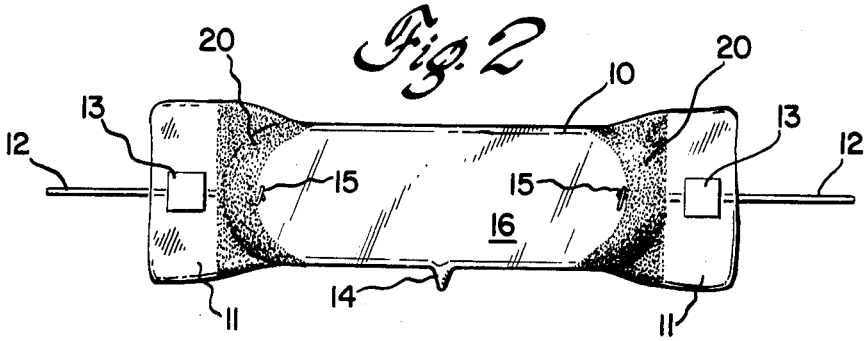
FIG. 2 is a top view illustrating a discharge tube with reflective coatings in accordance with the present invention.

FIG. 2 illustrates one embodiment of the present invention in which discharge tube 10 enclosing discharge medium 16 has disposed at the ends of said tube reflective coating 20 configured as shown. Conventionally, the coating is disposed at each end of the discharge tube so as to extend just beyond the ends of the electrodes 15 and coating the entire circumference of the discharge tube. However, in accordance with the present invention, the coating is applied in a conventional manner except for an approximately semicircular portion at each discharge tube end. The semicircular portion has its diameter approximately coincident with the conventional coating edge along the circumference of the tube 10. The semicircular transparent area extends to behind the electrode tip so as to expose more of the plasma arc. Such semicircular transparent portions are preferably disposed at each lamp end and are preferably oriented in approximately the same plane so as to direct the optical output of the lamp in approximately the same direction. The coating pattern of the present invention prevents a significant number of internal optical reflections from occurring and thereby increases the efficacy of the lamp. Furthermore, the coating pattern of the present invention exposes a greater length of the plasma arc discharge without significantly decreasing the heat reflective operation of the coating.

Also illustrated in FIG. 2 are wire leads 12 electrically connected to foil 13 which serves to provide a seal through the flanges 11 of the quartz tube 10. Additionally, tip-off 14 is shown through which outgassing and back-filling of the tube is typically accomplished.

Figure 3:
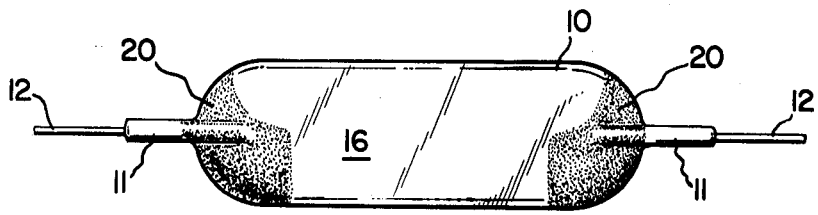
FIG. 3 is a side view of FIG. 2 further indicating the pattern of the reflective coatings in the present invention.

FIG. 3 is a side view of the discharge tube shown in FIG. 2 and further illustrates the coating patterns 20 of the present invention. As indicated above, certain high intensity discharge lamps are preferably operated with a particular orientation. These unique orientations typically are preferred either because of the presence of a structure providing a magnetic field or because of an arched discharge tube. While not confined to these particular instances, the coating pattern of the present invention is particularly suited for high intensity lamps in which such a unique orientation is desirable.

Additionally, it is to be noted that in FIGS. 2 and 3, and in FIG. 4 to be discussed below, the pinch-off flanges on the discharge tube are oriented in a plane which is approximately parallel to the plane containing the above-mentioned semicircular transparent portions. This orientation is desirable in that it acts to reduce heat loss from the lamp which occurs through convection. The end coatings themselves may comprise any conventional heat resistant radiation reflective coating. However, coatings comprising zirconium oxide or metal coatings of gold or platinum are preferred.

Figure 4:
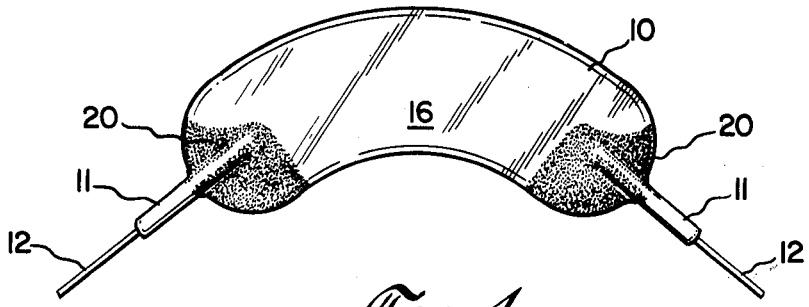
FIG. 4 is a side view of an arched discharge tube employing the coating pattern of the present invention and further illustrating the preferred orientation for pinch-off flanges.

FIG. 4 illustrates the orientation of the coatings employed in the present invention in the case in which an arched discharge tube 10 is employed. The semicircular portions of the coatings are disposed so that they are approximately perpendicular to the plane of the arch as shown in FIG. 4. Likewise, the pinch-off flanges 11 are also disposed in a plane approximately perpendicular to the plane containing the arch.

From the above, it may be appreciated that the coating patterns of the present invention provide greater lamp efficacy by reducing the number of multiple reflections and also by exposing a greater portion of the arc discharge. Nonetheless, the reflective coating patterns of the present invention operate to reflect radiant heat energy back into the arc tube so as to maintain the ionizable medium at an appropriate pressure. It may also be appreciated that the coating patterns of the present invention are employable in any high intensity discharge lamp of the kind considered herein but they are particularly useful in those discharge lamps designed to be operated in a horizontal position, either because the discharge tube is arched or because magnetic field structures are provided.

While this invention has been described with reference to particular embodiments and examples, other modifications and variations will occur to those skilled in the art in view of the above teachings. Accordingly, it should be understood that within the scope of the appended claims the invention may be practiced otherwise than is specifically described.

The invention claimed is:

1. In a high intensity arc discharge lamp including an outer envelope and inner, evacuable elongated discharge tube having electrodes disposed through substantially flat pinch-off flanges at opposed ends thereof and containing a discharge medium, one of the ends of each of said electrodes projecting into said medium, the improvement comprising:

a reflective coating on said discharge tube, said coating being disposed at, and covering the ends of said discharge tube and extending just beyond the ends of said electrodes projecting into said medium except for an approximately semicircularly shaped portion on at least one of said discharge tube ends, said semicircular portion lying in a plane approximately parallel to the plane containing said pinch-off flanges, and extending toward the nearest pinch-off flange to expose the end of the electrode so that a greater portion of the arc is exposed, whereby the amount of escaping light is increased, while sufficient reflective coating is retained to avoid a decrease in the heat reflective operation thereof.

2. The lamp of claim 1 in which said tube is arched and said semicircularly shaped portions lie in a plane approximately perpendicular to the plane of the arch.

3. The lamp of claim 2 in which the ends of said tube terminate in pinch-off flanges lying in a plane approximately perpendicular to the plane of the arch.

4. The lamp of claim 1 in which said reflective coating comprises material selected from the group consisting of zirconium oxide, platinum, and gold.

5. The lamp of claim 1 in which said coating is disposed on the interior of said discharge tube.

6. The lamp of claim 1 in which said coating is disposed on the exterior of said discharge tube.

* * * * *